US008015901B2

(12) United States Patent
Kanazawa et al.

(10) Patent No.: US 8,015,901 B2
(45) Date of Patent: Sep. 13, 2011

(54) TIE ROD ADJUSTMENT OPEN-END WRENCH

(75) Inventors: Atsushi Kanazawa, Takaishi (JP); Hiroharu Kato, Toyota (JP)

(73) Assignees: Toyota Jidosha Kabushiki Kaisha, Toyota-shi (JP); Shinmei Industry Co., Ltd., Toyota (JP)

( * ) Notice: Subject to any disclaimer, the term of this patent is extended or adjusted under 35 U.S.C. 154(b) by 132 days.

(21) Appl. No.: 12/419,027

(22) Filed: Apr. 6, 2009

(65) Prior Publication Data

US 2009/0260488 A1 Oct. 22, 2009

(30) Foreign Application Priority Data

Apr. 18, 2008 (JP) ..... 2008-109145

(51) Int. Cl.
*B25B 13/00* (2006.01)

(52) U.S. Cl. ..... 81/57.14; 81/57.18; 81/57.2

(58) Field of Classification Search ..... 81/57.14, 81/57.18, 57.2, 57.3
See application file for complete search history.

(56) References Cited

U.S. PATENT DOCUMENTS

| | | | | | |
|---|---|---|---|---|---|
| 3,892,148 | A * | 7/1975 | Wiley | 81/57.18 |
| 4,674,366 | A * | 6/1987 | Lauer et al. | 81/57.14 |
| 5,027,275 | A * | 6/1991 | Sakamoto et al. | 701/36 |
| 6,308,593 | B1 * | 10/2001 | Shibayama et al. | 81/58.2 |
| 7,357,053 | B2 * | 4/2008 | Doan | 81/57.14 |

FOREIGN PATENT DOCUMENTS

| | | |
|---|---|---|
| JP | 01177934 A | 7/1989 |
| JP | 01289770 | 11/1989 |
| JP | 02061779 | 5/1990 |
| JP | 2000289640 | 10/2000 |
| JP | 2004014907 | 1/2004 |
| JP | 2004017907 | 1/2004 |
| JP | 2004351603 | 12/2004 |

* cited by examiner

*Primary Examiner* — Hadi Shakeri
(74) *Attorney, Agent, or Firm* — Gifford, Krass, Sprinkle, Anderson & Citkowski, P.C.

(57) ABSTRACT

A clamping mechanism includes a pair of contact portions facing each other which is capable of directly contacting a tie rod hexagonal portion, and an open-close drive mechanism that causes the both contact portions to move away from and approach the tie rod hexagonal portion. By appropriately changing the distance between surfaces of the mutually facing pair of contact portions, the tie rod hexagonal portion will be securely clamped by the pair of contact portions, regardless of the size of the diameter of the tie rod. Then, the tie rod hexagonal portion is rotated to adjust the toe angle, by rotating the clamping mechanism via the rotation drive mechanism.

2 Claims, 6 Drawing Sheets

TIE ROD ADJUSTMENT OPEN-END WRENCH

INCORPORATION BY REFERENCE

The disclosure of Japanese Patent Application No. 2008-109145 filed on Apr. 18, 2008 including the specification, drawings and abstract is incorporated herein by reference in its entirety.

BACKGROUND OF THE INVENTION

1. Field of the Invention

The invention relates to a tie rod adjustment open-end wrench for rotating a tie rod hexagonal portion of a toe adjustment tie rod of a motor vehicle.

2. Description of the Related Art

An open-end wrench capable of automatically performing the toe adjustment of a motor vehicle by rotating tie rod hexagonal portions 12 of toe adjustment tie rods 10 as shown in FIG. 6 so as to extend or contract the tie rods 10 has been developed (see, e.g., Japanese Patent Application Publication No. 2000-289640 (JP-A-2000-289640), and Japanese Patent Application Publication No. 2004-17907 (JP-A-2004-17907)).

However, this tie rod adjustment open-end wrench transmits rotation force to the tie rod hexagonal portion 12 by a contact portion that contacts a surface of a corresponding tie rod hexagonal portion 12, or contacts two contiguous surfaces thereof, and is able to securely rotate the tie rod hexagonal portion 12 if the tie rod hexagonal portion 12 has a diameter that is assumed beforehand. However, since the tie rod hexagonal portions 12 vary in diameter from a vehicle model to another, it is often the case that the tie rod hexagonal portions 12 are gripped insufficiently by the tie rod adjustment open-end wrench, or is gripped with the center of the tie rod hexagonal portion 12 being off the center of rotation. Therefore, it is difficult to securely rotate the tie rod hexagonal portion 12.

SUMMARY OF THE INVENTION

The invention is intended to quickly and precisely perform the toe adjustment of a motor vehicle by securely gripping a tie rod hexagonal portion of a tie rod whose diameter varies depending on vehicle models so that the center of the tie rod hexagonal portion is positioned unfailingly at the rotation center, and then securely rotating the tie rod hexagonal portion.

An aspect of the invention relates to a tie rod adjustment open-end wrench that includes: a clamping mechanism that clamps a tie rod hexagonal portion by approaching a tie rod from a side of the tie rod; and a rotation drive mechanism that rotates the clamping mechanism while the tie rod hexagonal portion is clamped. The clamping mechanism includes: a pair of contact portions facing each other which is capable of directly contacting the tie rod hexagonal portion; and an open-close drive mechanism that causes the both contact portions to move away from and approach the tie rod hexagonal portion.

Since the clamping mechanism includes the pair of contact portions, and the open-close drive mechanism, the tie rod hexagonal portion is securely clamped by the pair of contact portions regardless of the size of the diameter of the tie rod, by appropriately changing the distance between the surfaces of the two mutually facing contact portions. Then, by rotating the clamping mechanism via the rotation drive mechanism, the tie rod hexagonal portion is rotated to adjust the toe angle.

The open-close drive mechanism of the clamping mechanism may include a mechanism that operates independently of the rotation drive mechanism. Since the open-close drive mechanism of the clamping mechanism operates independently of the rotation drive mechanism, the tie rod hexagonal portion is securely clamped regardless of the size of the diameter of the tie rod by appropriately changing the distance between the surfaces of the mutually facing contact portions, and then the tie rod hexagonal portion is rotated.

The open-close drive mechanism of the clamping mechanism may include: a pair of arms whose distal end portions move away from and approach each other, with fulcrums of the arms serving as rotation centers; a linear actuator; and a link mechanism that converts movement of the linear actuator into open-close movement of the pair of arms. Since the distal end portions of the pair of arms are moved away from and closer to each other by the linear actuator, friction wheels supported by shafts or the like, or journaled, respectively to the two arms are brought into contact with the tie rod hexagonal portion, and the tie rod hexagonal portion is securely clamped regardless of the size of the diameter of the tie rod.

A friction wheel as the contact portion may be journaled to each of the pair of arms, and the rotation drive mechanism may include a gear train for rotating all the friction wheels about axes of the friction wheels at the same speed in the same direction. While the tie rod hexagonal portion is clamped by the friction wheels, the tie rod hexagonal portion is rotated by rotating the friction wheels at the same speed in the same direction via the gear train of the rotation drive mechanism.

The open-close drive mechanism of the clamping mechanism may include a pair of slide plates that move away from and approach each other in slide movement, a linear actuator, a cam mechanism that converts movement of the linear actuator into open-close movement of the pair of slide plate, and a spring that urges the pair of slide plates always in opening directions. The pair of slide plates and the spring may be held rotatably about a center axis of the tie rod hexagonal portion by an annular external gear that is disposed at such a position as to surround the slide plates and the spring. The annular external gear may have a C-shape with a cutout portion, and the cutout portion may be disposed at an open-end portion into which the tie rod is inserted when the clamping mechanism approaches the tie rod from the side of the tie rod. Mutually facing end surfaces of the slide plates, as the contact portions, may be formed in a configuration of mutually parallel flat surfaces.

The pair of slide plates that move away from and approach each other in slide movement are urged always in the opening directions by the spring. Besides, the annular external gear disposed at such a position as to surround the pair of slide plates and the spring has a C-shape with a cutout portion, and the cutout portion is disposed at the open-end portion into which the tie rod is inserted when the clamping mechanism approaches the tie rod from a side of the tie rod. Hence, it is possible to when the open-end portion O the tie rod hexagonal portion having a permissible maximum diameter during a state in which the pair of slide plates are farthest apart from each other. Then, since the cam mechanism converts movement of the linear actuator into open-close movement of the two slide plates, the mutually facing end surfaces of the two slide plates which are formed in a configuration of mutually parallel flat surfaces are brought into contact with the tie rod hexagonal portion, and the tie rod hexagonal portion is securely clamped regardless of the size of the diameter of the tie rod.

The rotation drive mechanism may include the annular external gear, and a gear train for rotating the annular external gear. The pair of slide plates held by the annular external gear so as to be rotatable about center axis of the tie rod hexagonal portion are rotated to rotate the tie rod hexagonal portion, by driving the annular external gear via the gear train of the rotation drive mechanism while the tie rod hexagonal portion is clamped by the mutually facing end surfaces of the two slide plates that are the contact portions.

The open-close drive mechanism of the clamping mechanism may include a mechanism that is driven by the rotation drive mechanism. In the tie rod adjustment open-end wrench having this construction, the open-close drive mechanism of the clamping mechanism is driven by the rotation drive mechanism so as to appropriately change the distance between the surfaces of the two mutually facing contact portions so that the tie rod hexagonal portion can be securely clamped and the tie rod hexagonal portion can be securely rotated regardless of the size of the diameter of the tie rod.

The open-close drive mechanism of the clamping mechanism may include a pair of slide plates that move away from and approach each other in slide movement. Mutually facing end surfaces of the pair of slide plates, as the contact portions, may be formed in a configuration of mutually parallel flat surfaces, and the rotation drive mechanism may rotationally drive the pair of slide plates about a center axis of the tie rod hexagonal portion.

Since the mutually facing end surfaces of the two slide plates that are formed in the configuration of mutually parallel flat surfaces are brought into contact with the tie rod hexagonal portion, the tie rod hexagonal portion is securely clamped regardless of the size of the diameter of the tie rod. Then, while the tie rod hexagonal portion is clamped by the mutually facing end surfaces of the pair of slide plates that are contact portions, the tie rod hexagonal portion is rotated by driving the pair of slide plates about the center axis of the tie rod hexagonal portion via the rotation drive mechanism.

The rotation drive mechanism may include an annular external gear provided at such a position as to surround the clamping mechanism, a cam plate that closes a side end surface of the annular external gear, a cam surface that is an end surface of an opening formed in a central portion of the cam plate, and driven pieces that protrude from the pair of slide plates and that contact the cam surface of the cam plate so as to transmit rotation movement of the annular external gear to the pair of slide plates. The annular external gear may have a C-shape with a cutout portion, and the cutout portion may be disposed at an open-end portion into which the tie rod is inserted when the clamping mechanism approaches the tie rod from the side of the tie rod. The rotation drive mechanism may include a gear train for rotating the annular external gear. The open-close drive mechanism of the clamping mechanism may include a spring that urges the pair of slide plates always in opening directions, and a rotation plate that supports the pair of slide plates and the spring inside the annular external gear so as to be relatively rotatable. Deviation in phase between the annular external gear and the rotation plate may be converted into open-close movement of the pair of slide plates by the driven pieces moving along the cam surface of the cam plate.

The pair of slide plates and the spring that constitute the clamping mechanism are supported by the rotation plate so as to be rotatable relative to the annular external gear, and the pair of slide plates are urged always in the opening directions by the spring. Besides, the annular external gear provided at such a position as to surround the clamping mechanism has a C-shape with a cutout portion, and the cutout portion is disposed at the open-end portion into which the tie rod is inserted when the clamping mechanism approaches the tie rod from a side of the tie rod. Hence, it is possible to when the open-end portion the tie rod hexagonal portion having a permissible maximum diameter during a state in which the two slide plates are farthest apart from each other.

Then, when the annular external gear is rotationally driven by the gear train of the rotation drive mechanism, a change occurs in the rotation phase of the annular external gear and the rotation plate, and the driven pieces protruded from the two slide plates and being in contact with the cam surface of the cam plate are guided by the cam surface of the cam plate that closes the side end surface of the annular external gear, and thus convert the rotation of the annular external gear into open-close movements of the two slide plates. Specifically, the open-close drive mechanism, which is driven by the rotation drive mechanism, is able to securely clamp the tie rod hexagonal portion regardless of the size of the diameter of the tie rod, by bringing the mutually facing end surfaces of the two slide plates which are formed in a configuration of mutually parallel flat surfaces into contact with the tie rod hexagonal portion.

Besides, when the mutually facing end surfaces of the slide plates contact the tie rod hexagonal portion, the driven pieces protruded from the two slide plates are restricted from moving relative to the cam surface of the cam plate, and the driven pieces are rotationally driven by the cam plate without sliding relative to the cam surface of the cam plate. Thus, the rotation movement of the annular external gear is transmitted to the two slide plates. Hence, the two slide plates and the rotation plate supporting the slide plates rotate integrally with the annular external gear. Thus, it is possible to rotate the tie rod hexagonal portion 12 by driving the two slide plates 74 about the center axis 12C of the tie rod hexagonal portion.

The rotation drive mechanism may include an annular sun gear provided at such a position as to surround the clamping mechanism, a planetary gear positioned radially outwardly of the sun gear, and an annular outer ring gear positioned radially outwardly of the planetary gear. Each of the sun gear and the outer ring gear may have a C-shape with a cutout portion, and the cutout portion of the sun gear and the cutout portion of the outer ring gear may be disposed at an open-end portion into which the tie rod is inserted when the clamping mechanism approaches the tie rod from the side of the tie rod. Teeth may be formed on an inner peripheral surface of the sun gear, and on an outer peripheral surface of the outer ring gear, and a gear train that drives the teeth of the outer peripheral surface of the outer ring gear may be provided. The open-close drive mechanism of the clamping mechanism may include a slide plate drive gear that is journaled to a proximal end portion side of the pair of slide plates so as to be rotatable together with the pair of slide plates about the center axis of the tie rod hexagonal portion, and that meshes with the teeth formed on the inner peripheral surface of the sun gear, and a link mechanism that converts rotation movement of the slide plate drive gear into slide movement of the pair of slide plates. Each of the annular sun gear and the annular outer ring gear that are provided at such positions as to surround the clamping mechanism has a C-shape with a cutout portion, and the cutout portions thereof are disposed at the open-end portion into which the tie rod is inserted when the clamping mechanism approaches the tie rod from a side of the tie rod. Hence, it is possible to when the open-end portion the tie rod hexagonal portion having a permissible maximum diameter during a state in which the two slide plates are farthest apart from each other.

When the annular outer ring gear is rotationally driven by the gear train of the rotation drive mechanism during a state in which the revolution of the planetary gear about the axis of the sun gear has been stopped, and the rotation of the planetary gear about its own axis is possible, rotation of the annular outer ring gear is transmitted to the annular sun gear, and therefore the slide plate drive gear meshed with the teeth formed on the inner peripheral surface of the sun gear rotates. Then, rotation movement of the slide plate drive gear is converted into slide movements of the two slide plates by the link mechanism. That is, by using the open-close drive mechanism to bring the mutually facing end surfaces of the slide plates, which are formed in a configuration of mutually parallel flat surfaces, into contact with the tie rod hexagonal portion by the operation of the rotation drive mechanism, the clamping mechanism securely clamps the tie rod hexagonal portion regardless of the size of the diameter of the tie rod. Besides, as the mutually facing end surfaces of the slide plates contact the tie rod hexagonal portion and the two slide plates stops, the rotation of the slide plate drive gear is restricted, bringing about a state in which the slide plate drive gear, the annular sun gear, and the planetary gear are all locked, and rotate integrally with the annular outer ring gear. At this time, the two slide plates and the slide plate drive gear also rotate, together with the annular outer ring gear, about the center axis of the tie rod hexagonal portion, thereby rotationally driving the tie rod hexagonal portion.

Since the invention is constructed as described above, it becomes possible to quickly and precisely perform the toe adjustment of a motor vehicle by securely gripping a tie rod hexagonal portion of a tie rod whose diameter varies depending on vehicle models or the like so that the center of the tie rod hexagonal portion is positioned unfailingly at the rotation center, and by securely rotating the tie rod hexagonal portion.

A second aspect of the invention relates to an open-end wrench that includes a clamping mechanism that clamps a hexagonal portion, and a rotation drive mechanism that rotates the clamping mechanism while the hexagonal portion is clamped. The clamping mechanism includes a pair of contact portions facing each other which is capable of directly contacting the hexagonal portion, and an open-close drive mechanism that causes the both contact portions to move away from and approach the hexagonal portion.

The open-end wrench may also be used for a purpose other than the tie rod adjustment.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein.

DETAILED DESCRIPTION OF EMBODIMENTS

Figure 1:
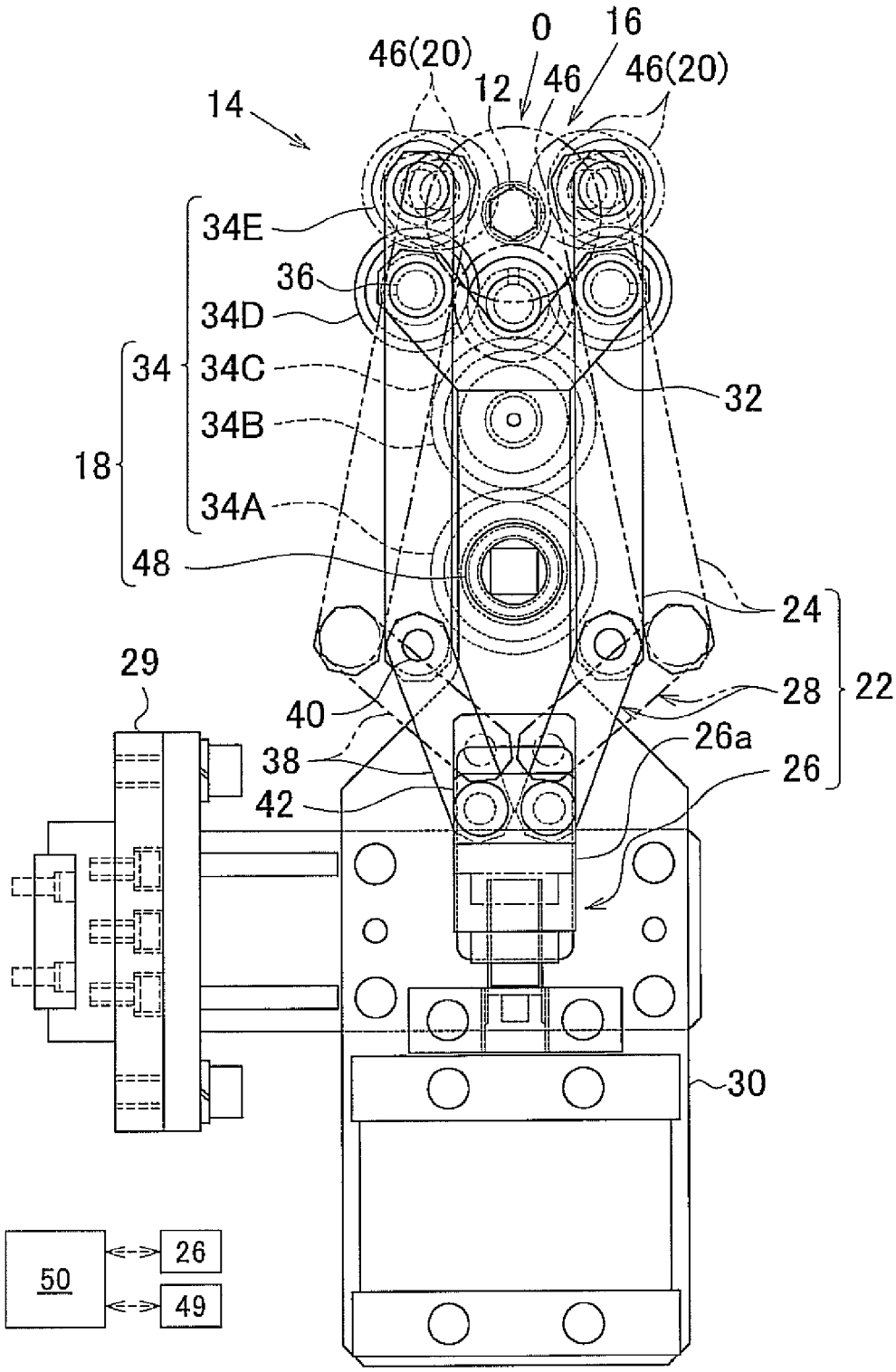
FIG. 1 is a front view of a tie rod adjustment open-end wrench in accordance with a first embodiment of the invention.
Figure 2:
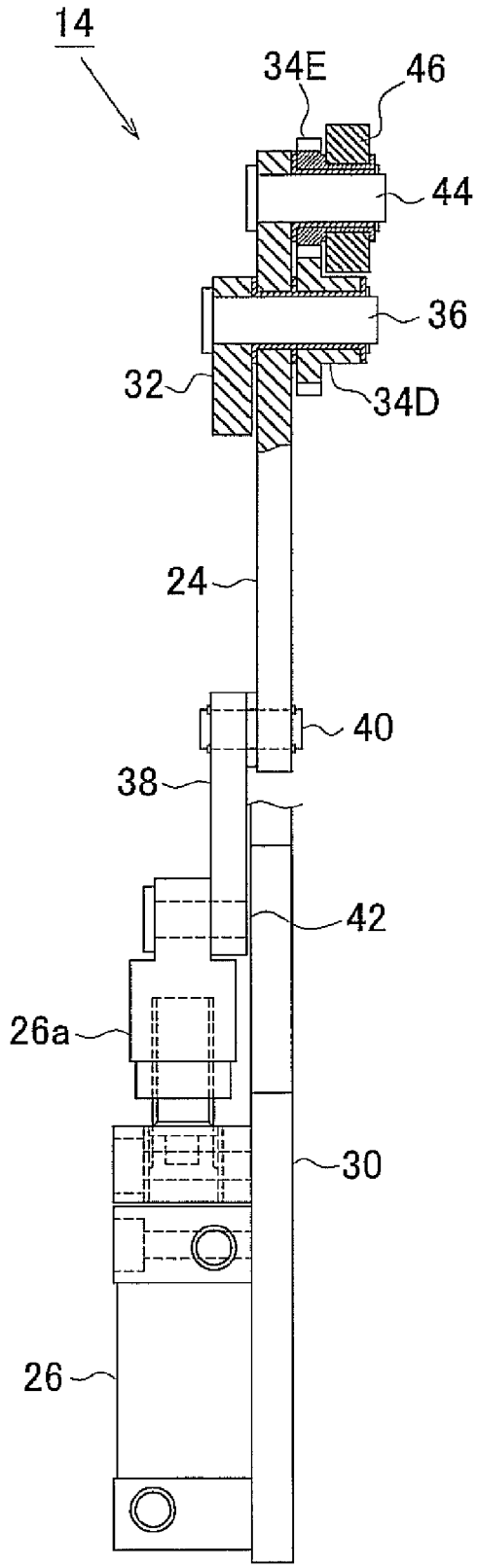
FIG. 2 is a side view of the tie rod adjustment open-end wrench shown in FIG. 1.

Hereinafter, embodiments of the invention will be described with reference to drawings. Incidentally, the portions and the like of the embodiments that are the same as or comparable to those of the related art shown in HG 6 will not be described in detail. FIG. 1 and FIG. 2 show a tie rod adjustment open-end wrench 14 (hereinafter, simply referred to as "open-end wrench") in accordance with a first embodiment of the invention. The open-end wrench 14 includes a clamping mechanism 16 for clamping a tie rod hexagonal portion 12 (see FIG. 6) by approaching the tie rod 10 (see FIG. 6) from a side of the tie rod 10, and a rotation drive mechanism 18 for rotating the clamping mechanism 16 while the tie rod hexagonal portion 12 is clamped. The clamping mechanism 16 includes a pair of contact portions 20 facing each other which are provided for directly contacting the tie rod hexagonal portion 12, and an open-close drive mechanism 22 for causing the both contact portions 20 to move away from and approach the tie rod hexagonal portion 12. Then, the open-close drive mechanism 22 of the clamping mechanism 16 includes a mechanism that operates independently of the rotation drive mechanism 18. In addition, the clamping mechanism 16 is disposed at an open end portion O of the open-end wrench 14.

More concretely, the open-close drive mechanism 22 of the clamping mechanism 16 includes a pair of arms 24, a linear actuator 26, and a link mechanism 28 that converts movements of the linear actuator 26 into open-close movements of the two arms 24. The two arms 24 are attached by a shaft or the like, coaxially with a pair of rotation shafts 36 of a pair of gears 34D in a gear train 34 constituting the rotation drive mechanism 18, to a V-shaped bracket 32 provided on an distal end portion of a base plate 30 fixed to a distal end portion 29 of a robot arm of a multi-axis robot. In the link mechanism 28, a proximal end portion of each of the two arms 24 is attached by a shaft or the like, via a link rod 38 and pivots 40 and 42, to a piston rod 26*a* of a linear actuator (air cylinder) 26 fixed to the base plate 30. Therefore, as the piston rod 26*a* of the linear actuator 26 is moved, the two arms 24 turn about their fulcrums (the rotation shafts 36) so that distal end portions of the two arms 24 move away from and approach each other. In addition, in FIG. 1, when the distal end portions of the two arms 24 are the farthest apart from each other (standby state) is shown by solid lines, and when the distal end portions of the two arms 24 are close to each other and the two contact portions 20 are in contact with the tie rod hexagonal portion 12 is shown by dashed two-dotted lines.

Gears 34E, which are always in mesh with the gears 34D are attached by rotation shafts 44 to the each of two arms 24. Furthermore, friction wheels 46 that constitute the contact portions 20 are attached by shafts or the like so as to be rotatable together with the gears 34E. The friction wheels 46 used herein are wheels that have been appropriately treated so as to increase the friction coefficient of the contact surfaces, such as wheels whose contact surfaces are provided with irregularities, such as serrations, knurls or the like, wheels whose contact surfaces have been treated with sandblast, wheels covered with an urethane layer, etc.

On the other hand, the rotation drive mechanism 18 includes a gear train 34, and a drive shaft 48 that is linked to a rotation shaft of a motor. Gears 34A, 34B and 34C (all shown only in FIG. 1) constituting the gear train 34 are disposed in line, and are attached by shafts or the like to the base plate 30, and are meshed with each other in that order. Then, the two gears 34D attached to the V-shaped bracket 32 by the rotation shafts 36 are disposed equidistantly from the gear 34C, and are in mesh with the gear 34C. The friction wheels 46 are attached by shafts or the like to the gear 34C so as be rotatable integrally with the gear 34C. On the other hand, a motor (servo motor) linked to the drive shaft 48 is fixed to the base plate 30 as appropriate. Then, by driving the drive shaft 48 via the motor, the power of the motor is transmitted by the gear train 34, so that the three friction wheels 46 that rotate integrally with the gear 34C and the gears 34E are rotated about their own axes at the same speed in the same direction. In addition, FIG. 1 schematically shows the linear actuator 26, a motor 49 that drives the drive shaft 48, and a control device 50 that operates and controls the linear actuator 26 and the motor 49. The control device 50 can be constructed by an electronic calculator such as a personal computer or the like. Movements of various portions of the open-end wrench 14 are automatically performed by a procedure described below.

Figure 6:
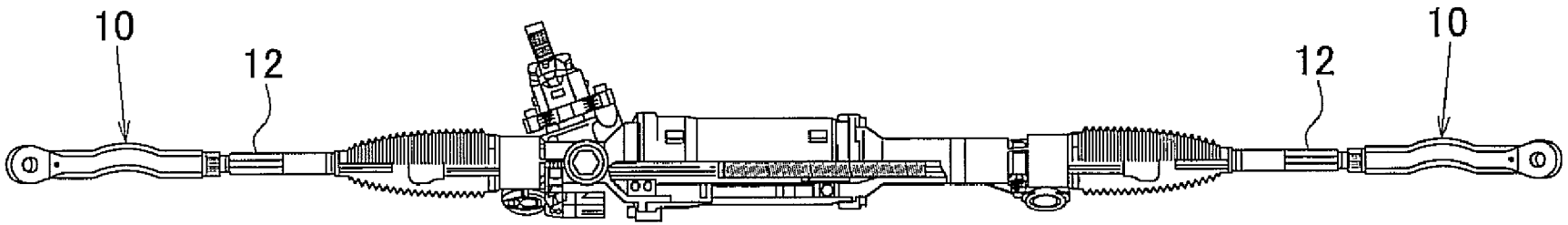
FIG. 6 RELATED ART
FIG. 6 is a drawing showing a toe adjustment tie rod of a motor vehicle.

With reference to FIG. 1, FIG. 2 and FIG. 6, a procedure of the toe adjustment for a motor vehicle that uses the open-end wrench 14 will be described. (S1) A vehicle is carried to a toe adjustment facility. The toe adjustment facility includes an operator panel, and an alignment measurement device. (S2) A start switch of the operation panel is operated by a worker. (S3) A robot arm is activated, and the open-end wrench 14 approaches the tie rod 10 from a side of the tie rod 10 so that the open-end portion O is brought to the tie rod hexagonal portion 12. Then, the linear actuator 26 is activated by the control device 50 so that the contact portions 20 (the friction wheels 46) supported by shafts or the like on the two arms 24, are brought into contact with the tie rod hexagonal portion 12. The stop positions of the two arms 24 are determined by, for example, detecting the load of the linear actuator 26. (S4) The toe angle is measured by an alignment measurement device. (S5) The control device 50 then calculates the amount of rotation necessary to achieve the proper toe-in angle. (S6) The motor 49 is activated by the control device 50 to rotate the three friction wheels 46 about their own axes, whereby the tie rod hexagonal portion 12 is rotated. In this operation, the actuator 26 that drives the two arms 24 is passively activated so as to permit the two arms 24 to slightly open and close so that each of the friction wheels 46 contacts the surfaces of the tie rod hexagonal portion 12 with an appropriate contact pressure. (S7) The toe angle is measured by the alignment measurement device. (S8) The steps S5 to S7 are repeated until the toe angle reaches a proper value. (S9) After the toe angle has reached the proper value, the control device 50 activates the linear actuator 26 so as to open the two arms 24, so that the tie rod hexagonal portion 12 is released. Then, the robot arm is activated to return the open-end wrench 14 to the standby position.

According to the first embodiment of the invention having the foregoing construction, it becomes possible to achieve operation and effects as follows. The clamping mechanism 16 of the open-end wrench 14 includes the two mutually facing contact portions 20 that directly contact the tie rod hexagonal portion 12, and with the open-close drive mechanism 22 for moving the two arms 22 away from and closer to the tie rod hexagonal portion 12. Therefore, by appropriately changing the distance between the surfaces of the two mutually facing contact portions 20, the contact portions 20 securely clamp the tie rod hexagonal portion 12 regardless of the size of the diameter of the tie rod 10. Then, by rotating the clamping mechanism 16 via the rotation drive mechanism 18, the tie rod hexagonal portion 12 is rotated to perform the toe adjustment. In addition, the open-close drive mechanism 22 of the clamping mechanism 16 operates independently of the rotation drive mechanism 18.

Besides, by moving the distal end portions of the two arms 24 away from and closer to each other via the linear actuator 26, the open-end wrench 14 is able to bring the friction wheels 46 journaled to the two arms 24 into contact with the tie rod hexagonal portion 12 and thus securely clamp the tie rod hexagonal portion 12 regardless of the size of the diameter of the tie rod 10. Then, the open-end wrench 14 is able to rotate the tie rod hexagonal portion 12 by rotating all the friction wheels 46 at the same speed in the same direction via the gear train 34 of the rotation drive mechanism 18 while the tie rod hexagonal portion 12 is clamped by the friction wheels 46. Therefore, according to the foregoing open-end wrench 14, it becomes possible to quickly and precisely perform the toe adjustment of a motor vehicle by securely gripping a tie rod hexagonal portion 12 of a tie rod whose diameter varies depending on vehicle models or the like so that the center of the tie rod hexagonal portion 12 is positioned unfailingly at the rotation center, and by securely rotating the tie rod hexagonal portion 12.

Figure 3B:
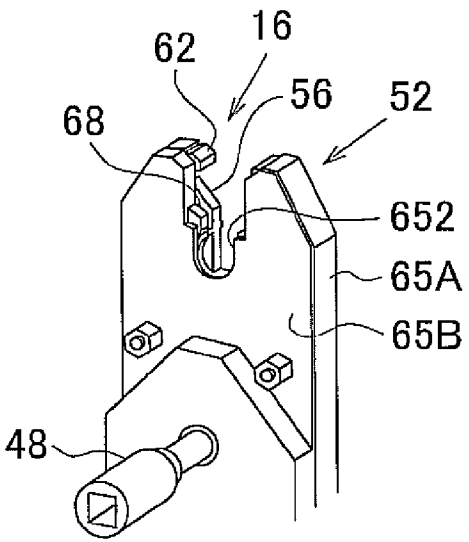
FIG. 3B shows an as-assembled drawing of portions of the tie rod adjustment open-end wrench in accordance with the second embodiment of the invention.
Figure 3A:
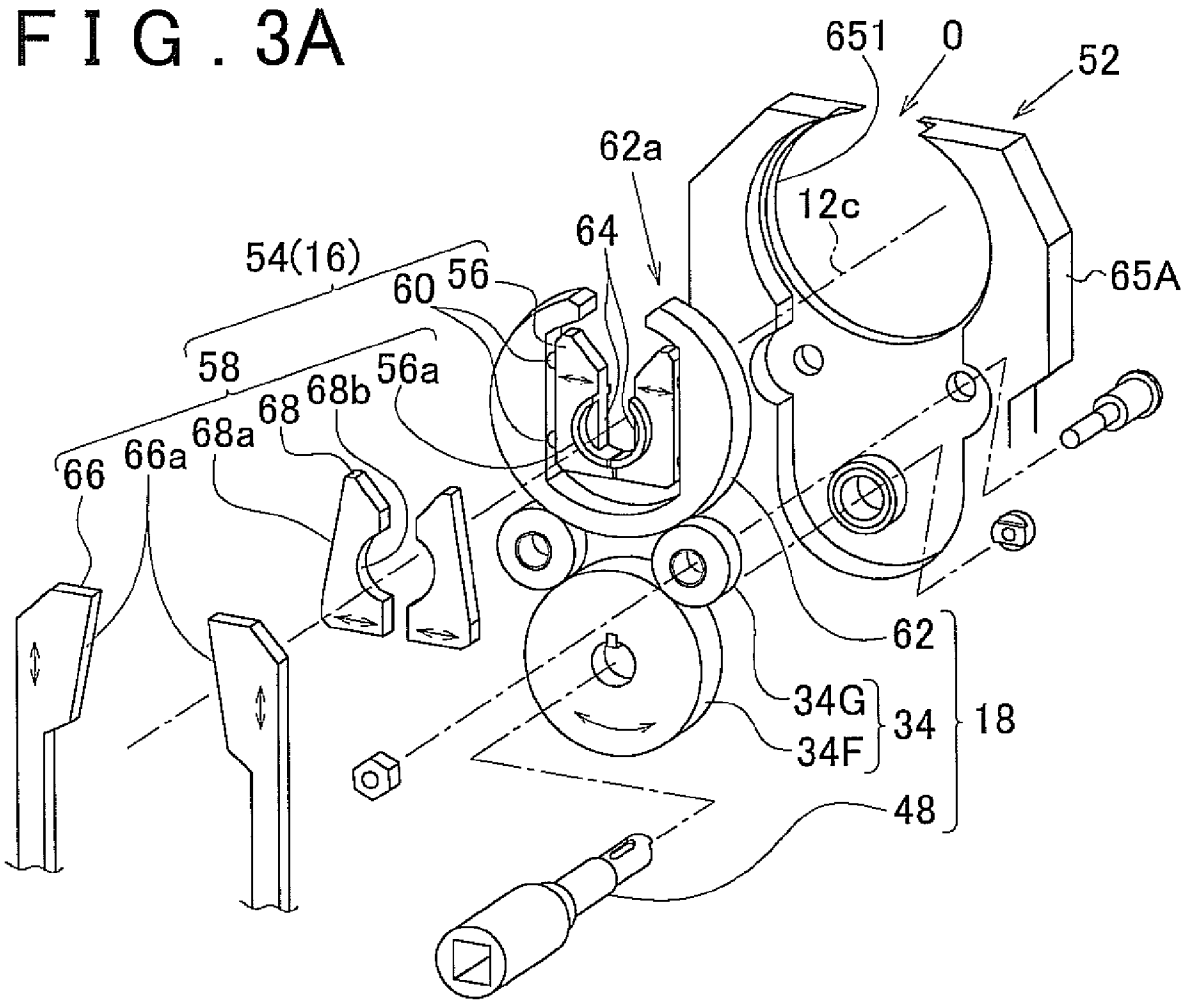
FIG. 3A shows an exploded view of portions of a tie rod adjustment open-end wrench in accordance with a second embodiment of the invention.

Subsequently, with reference to FIGS. 3A and 3B, a tie rod adjustment open-end wrench 52 (hereinafter, simply referred to as "open-end wrench") in accordance with a second embodiment of the invention will be described. It is to be noted herein that portions of the open-end wrench 52 in accordance with the second embodiment that are the same as or comparable to those of the open-end wrench 14 in accordance with the first embodiment of the invention are represented by the same reference numerals, and detailed descriptions thereof will be omitted. In addition, FIG. 3A shows an exploded view of portions of the open-end wrench 52, and FIG. 3B shows an as-assembled diagram of the open-end wrench 52.

An open-close drive mechanism 54 of a clamping mechanism 16 of the open-end wrench 52 includes a mechanism that operates independently of a rotation drive mechanism 18, as in the open-end wrench 14 in accordance with the first embodiment. Concretely, the open-close drive mechanism 54 includes a pair of slide plates 56 that slide away from and closer to each other, a linear actuator (see FIG. 1 and FIG. 2) similar to the linear actuator 26 in accordance with first embodiment, a cam mechanism 58 that converts movements of the linear actuator 26 into open-close movements of the two slide plates 56, and springs 60 that urge the two slide plates 56 always in the opening direction. The two slide plates 56, and the springs 60 are held so as to be rotatable about a center axis 12C of a tie rod hexagonal portion by an annular external gear 62 (whose teeth are omitted from the illustration for the convenience sake) that is disposed at such a position as to surround the slide plates 56 and the springs 60. Besides, mutually facing end surfaces 64 of the two slide plates 56 form flat surfaces that are parallel to each other, and thus construct contact portions that directly contact the tie rod hexagonal portion 12. In addition, the annular external gear 62 has a C-shape with a partial cut out.

Besides, the rotation drive mechanism 18 of the open-end wrench 52 includes an annular external gear 62, a gear train 34 for rotating the annular external gear 62, and a drive shaft 48 linked to the rotation shaft of a motor. The gear train 34 includes a gear 34F fixed to the drive shaft 48 linked to the rotation shaft of the motor, and a pair of gears 34G disposed between the gear 34F and the annular external gear 62. The component members of the rotation drive mechanism 18 and the open-close drive mechanism 54 are contained within a base plate 65A and a plate cover 65B. A cutout portion 62*a* of the annular external gear 62 is disposed at an open-end portion O formed in the base plate 65A and the plate cover 65B which receives the tie rod hexagonal portion 12 (FIG. 6) when the open-end wrench 52 approaches the tie rod 10 from a side of the tie rod 10, i.e., which accommodates the tie rod hexagonal portion 12. The linear actuator 26 (see FIG. 1 and FIG. 2) and the motor are also fixed to the base plate 65A or the plate cover 65B. Incidentally, the base plate 65A and the plate cover 65B are provided with cutouts 651 and 652, respectively, into which the tie rod hexagonal portion 12 is inserted.

The cam mechanism 58 of the open-close drive mechanism 54 includes a pair of up-and-down cam plates 66 that are moved up and down by a cylinder rod 26*a* (see FIG. 1 and FIG. 2) of the linear actuator 26, and a pair of transverse cam plates 68 that have inclined surfaces 68*a* that are in sliding contact with mutually facing inclined surfaces 66*a* of the up-and-down cam plates 66. The two up-and-down cam plates 66 are able to move only up and down within the base plate 65A and the plate cover 65B, and the motion thereof in the lateral directions in FIG. 3 is restricted. Besides, the two transverse cam plates 68 are able to move only in transverse directions within the base plate 65A and the plate cover 65B, and the motion thereof in up-down directions in FIG. 3 is restricted. Besides, the cam mechanism 58 includes arc-shape sliding-contact portions 68*b* that are formed on the two transverse cam plates 68 so as to allow relative rotation of the two transverse cam plates 68 and the two slide plates 56 and so as to transmit the open-close movements of the two transverse cam plates 68 to the two slide plates 56, and arc-shape protruded portions 56*a* that protrude in the direction of the center axis 12C of the tie rod hexagonal portion so as to surround the mutually facing end surfaces of the two slide plates 56, and that slidingly contact the arc-shape sliding-contact portions 68*b*.

In the example shown in FIG. 3, as the two up-and-down cam plates 66 descend, the two transverse cam plates 68 slide in such directions as to approach each other, and the movements of the two transverse cam plates 68 are transmitted to the slide plates 56 via the arc-shape sliding-contact portions 68*b* and the arc-shape protruded portions 56*a*. Therefore, the two slide plates 56 slide in such directions as to approach each other against the urging force of the springs 60 in the opening directions, until the mutually facing end surfaces 64 of the two slide plates 56 that are contact portions come into contact with the tie rod hexagonal portion 12 (FIG. 6). Thus, the two slide plates 56 can securely clamp the tie rod hexagonal portion 12 regardless of the size of the diameter of the tie rod 10. If, from this state, the gear train 34 is driven by the motor, the annular external gear 62 rotates, and the two slide plates 56 and the springs 60 rotate, together with the annular external gear 62, about the center axis 12C of the tie rod hexagonal portion.

On the other hand, when the two up-and-down cam plates 66 ascend, the two transverse cam plates 68 slide in such directions as to move away from each other, so that due to the urging force of the springs 60 in the opening directions, the two slide plates 56 slide in the opening directions. Incidentally, the toe adjustment procedure for a motor vehicle using the open-end wrench 52 is substantially the same as the procedure using the open-end wrench 14 in accordance with the first embodiment, and the detailed description of the procedure is omitted herein.

According to the second embodiment of the invention having the foregoing construction, it becomes possible to achieve operation and effects as follows. That is, in the open-end wrench 52, the two slide plates 56 that move away from and approach each other in slide movement are urged always in the opening directions by the springs 60. Besides the annular external gear 62 disposed at such a position as to surround the two slide plates 56 and the springs 60 has a C-shape with a partial cutout, and the cutout portion 62*a* is disposed at the open-end portion O that approaches the tie rod 10 from a side of the tie rod. Hence, it is possible to accommodate the hexagonal portion 12 of a permissible maximum diameter in the open-end portion O when the two slide plates 56 are farthest apart from each other.

Then, by the cam mechanism 58 converting movements of the linear actuator 26 (FIG. 1, FIG. 2) into open-close movements of the two slide plates 56, the mutually facing end surfaces 64 of the two slide plates 56 which are formed in a configuration of mutually parallel flat surfaces can be brought into contact with the tie rod hexagonal portion 12, and the tie rod hexagonal portion 12 can securely be clamped regardless of the size of the diameter of the tie rod 10. Besides, by driving the annular external gear 62 via the gear train 34 of the rotation drive mechanism 18 while the tie rod hexagonal portion 12 is clamped by the mutually facing end surfaces 64 of the two slide plates that are contact portions, the open-end wrench 52 can rotate the rotatably held two slide plates 56 about the center axis 12C of the tie rod hexagonal portion 12 via the annular external gear 62, thereby rotating the tie rod hexagonal portion 12. Substantially the same operation and effects as those of the first embodiment of the invention will not be described in detail again.

Figure 4:
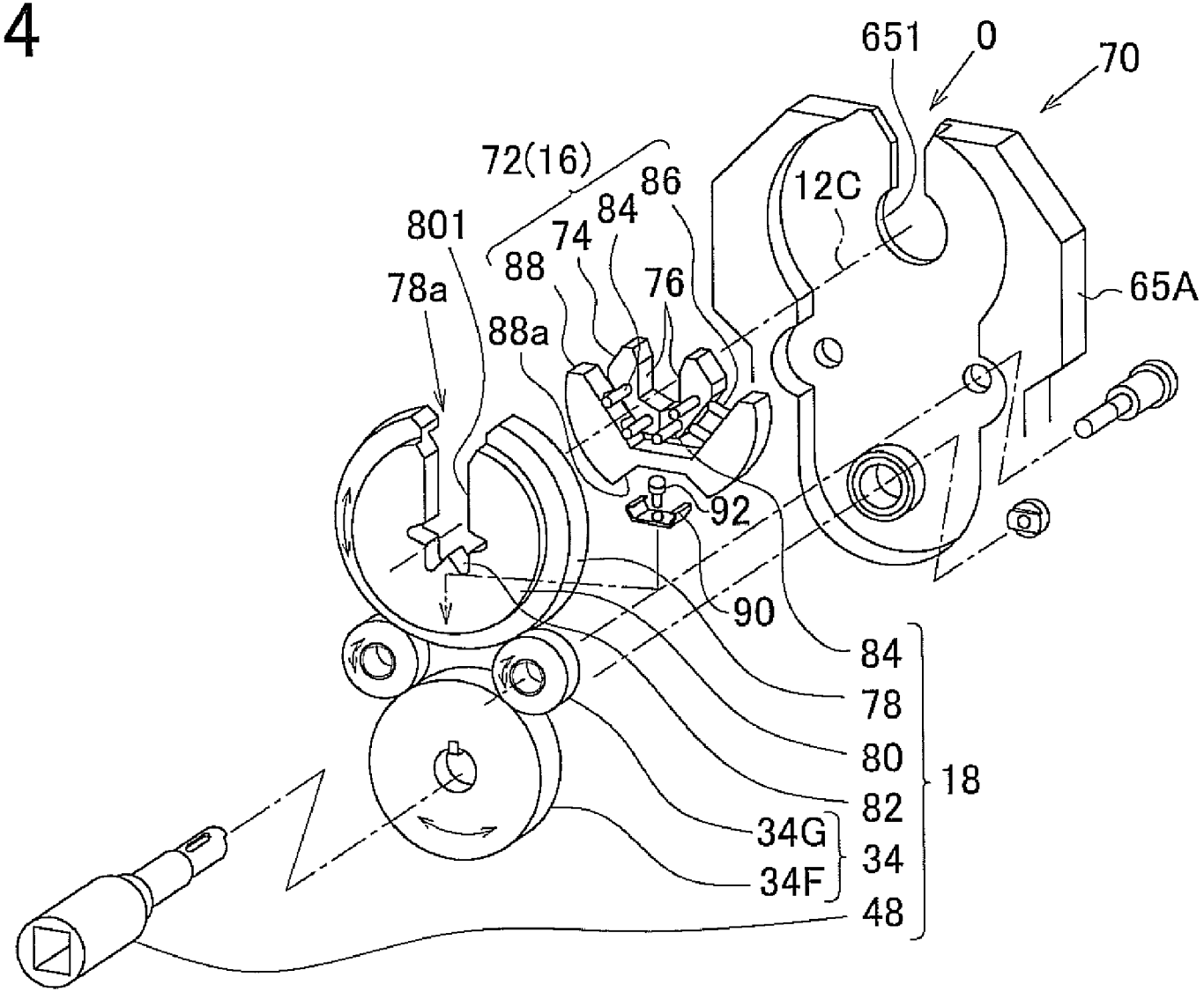
FIG. 4 is an exploded view of portions of a tie rod adjustment open-end wrench in accordance with a third embodiment of the invention.

Subsequently, with reference to FIG. 4, a tie rod adjustment open-end wrench 70 (open-end wrench) in accordance with a third embodiment of the invention. It is to be noted herein that portions of the open-end wrench 70 in accordance with the third embodiment that are the same as or comparable to those of the open-end wrenches 14 and 52 in accordance with the first and second embodiments of the invention are represented by the same reference numerals, and detailed descriptions thereof will be omitted. In addition, the external appearance of the open-end wrench 70 in accordance with the third embodiment of the invention is substantially the same as that of the open-end wrench 52 in accordance with the second embodiment. Therefore, FIG. 4 shows only portions in an exploded view of the open-end wrench 70, and an as-assembled diagram is omitted.

The open-end wrench 70 in accordance with the third embodiment of the invention, unlike the open-end wrenches 14 and 52 in accordance with the first and second embodiment, includes a mechanism in which the open-close drive mechanism 72 of the clamping mechanism 16 is driven by a rotation drive mechanism 18. Concretely, the open-close drive mechanism 72 of the clamping mechanism 16 includes a pair of slide plates 74 that move away from and approach each other in slide movement, and mutually parallel end surfaces 76 of the two slide plates are formed in a configuration of mutually parallel flat surfaces, as the two contact portions facing each other which is capable of directly contacting the tie rod hexagonal portion 12 (FIG. 6). Besides, the rotation drive mechanism 18 rotationally drives the two slide plates 74 about the center axis 12C of the tie rod hexagonal portion.

More concretely, the rotation drive mechanism 18 includes an annular external gear 78 provided at such a position as to surround the clamping mechanism 16, a cam plate 80 that closes a side end surface of the annular external gear 78, a cam surface 82 that is an end surface of an opening provided in a central portion of the cam plate 80, pin-shape driven pieces 84 that protrude from the two slide plates 74 and that contact the cam surface 82 of the cam plate 80 so as to transmit the rotation movement of the annular external gear 78 to the two slide plates 74, and a gear train 34 for rotating the annular external gear 78. The gear train 34 in this embodiment, as in the open-end wrench 52 in accordance with the second embodiment of the invention, includes a gear 34F fixed to a drive shaft 48 liked to a rotation shaft of a motor, and a pair of gears 34G disposed between the gear 34F and the annular external gear 62. Besides, the annular external gear 78, similar to the annular external gear 62 of the open-end wrench 52 in accordance with the second embodiment of the invention, has a C-shape with a partial cutout, and the cutout portion 78*a* is disposed at an open-end portion O of a base plate 65A and a plate cover 65B (see FIG. 3) which receives the tie rod hexagonal portion 12 when the open-end wrench 70 approaches the tie rod 10 from a side of the tie rod 10. Besides, the cam plate 80 is provided with a cutout into which the tie rod hexagonal portion 12 is inserted, and the cam surface 82 is formed in a deep end portion of the cutout 801.

Besides, the open-close drive mechanism 72 of the clamping mechanism 16 includes springs 86 that urge the two slide plates 74 always in opening directions, and a rotation plate 88 that supports the two slide plates 74 and the springs 86 rotatably relative to the annular external gear 78. As the driven pieces 84 move along the cam surface 82 of the cam plate 80, the phase deviation between the annular external gear 78 and the rotation plate 88 is converted into open-close movements of the two slide plates 74. In addition, in the drawing, a leaf spring 90 is fixed by a screw 92 to an inner peripheral surface of the annular external gear 78. By the leaf spring 90 contacting a spring bearing surface 88*a* of the slide plate 88, the phase of the slide plate 88 relative to the annular external gear 78 is always urged toward a center position. Besides, by appropriate elastic deformation of the leaf spring 90, the phase deviation between the annular external gear 78 and the rotation plate 88 is permitted.

The cam surface 82 of the cam plate 80 has a left-right symmetric shape similar to a star shape. When the phase of the slide plate 88 relative to the annular external gear 78 is at the center position, the driven pieces 84 of the two slide plates 74 are positioned in vertex portions of the arm portions of the star-shape cam surface 82. If the gear train 34 is driven by the motor, the annular external gear 78 rotates, and the slide plate 88 rotates relative to the annular external gear 78. At this time, the driven pieces 84 of the two slide plates 74 slide along the star-shape cam surface 82 from the vertex portions of the arms of the star-shape cam surface 82, and thus move toward the center axis 12C of the tie rod hexagonal portion 12. Therefore, the two slide plates 74 approach each other against the urging force of the springs 84 in the opening directions, until the mutually facing end surfaces 76 of the two slide plates 74 that are contact portions contact the tie rod hexagonal portion 12 (FIG. 6). Thus, the two slide plates 74 can securely clamp the tie rod hexagonal portion 12 regardless of the size of the diameter of the tie rod 10. If, from this state, the gear train 34 is driven by the motor, the annular external gear 78 rotates, and the two slide plates 74 and the springs 86 rotate, together with the annular external gear 78, about the center axis 12C of the tie rod hexagonal portion.

The movement of the slide plates 74 is caused by moving the annular external gear 62 in either direction since the cam surface 82 of the cam plate 80 has a left-right symmetric shape similar to a star shape. On the other hand, the slide plate 88 is always urged by the leaf spring 90 toward the center position relative to the annular external gear 78. Therefore, when the driving of the gear train 34 by the motor is stopped, the relative displacement between the annular external gear 78 and the slide plate 88 is automatically cancelled, that is, the two slide plates 74 are moved away from each other and are returned to the open position by the urging force of the springs 84 in the opening directions. Incidentally, the toe adjustment procedure for a motor vehicle using the open-end wrench 70 is substantially the same as the procedure using the open-end wrench 14 in accordance with the first embodiment, and the detailed description of the procedure is omitted herein.

According to the third embodiment of the invention having the foregoing construction, it becomes possible to achieve operation and effects as follows. The open-end wrench 70 is able to securely clamp the tie rod hexagonal portion 12 regardless of the size of the diameter of the tie rod 10, by bringing the mutually facing end surfaces 76 of the two slide plates 74 which are formed in a configuration of mutually parallel flat surfaces into contact with the tie rod hexagonal portion 12 (FIG. 6). Then, the open-end wrench 70 rotates the tie rod hexagonal portion 12 by rotating the two slide plates 74 about the center axis 12C of the tie rod hexagonal portion via the rotation drive mechanism 18 during a state in which the tie rod hexagonal portion 12 is clamped by the mutually facing end surfaces 76 of the two slide plates that are contact portions.

Besides, the two slide plates 74 and the springs 86 that constitute the clamping mechanism 16 are supported by the rotation plate 88 rotatably relative to the annular external gear 78, and the two slide plates 74 are urged always in the opening directions by the springs 86. Besides the annular external gear 78 disposed at such a position as to surround the clamping mechanism 16 has a C-shape with a partial cutout, and the cutout portion is disposed at the open-end portion O into which the tie rod hexagonal portion 12 is inserted when the clamping mechanism 16 approaches the tie rod 10 from a side of the tie rod. Hence, it is possible to accommodate the tie rod hexagonal portion 12 of a permissible maximum diameter in the open-end portion O when the two slide plates 74 are farthest apart from each other.

When the annular external gear 78 is rotationally driven by the gear train 34 of the rotation drive mechanism 18, a change occurs in the rotation phase of the annular external gear 78 and the rotation plate 88, and the driven pieces 84 protruded from the two slide plates 74 and being in contact with the cam surface 82 of the cam plate 80 are guided by the cam surface 82 of the cam plate 80 that closes the side end surface of the annular external gear 78, and thus convert the rotation of the annular external gear 78 into open-close movements of the two slide plates 74. Specifically, the open-close drive mechanism 72, which is driven by the rotation drive mechanism 18, is able to securely clamp the tie rod hexagonal portion 12 regardless of the size of the diameter of the tie rod 10, by bringing the mutually facing end surfaces 76 of the two slide plates 74 which are formed in a configuration of mutually parallel flat surfaces into contact with the tie rod hexagonal portion 12.

Besides, when the mutually facing end surfaces 76 of the slide plates 74 contact the tie rod hexagonal portion 12, the driven pieces 84 protruded from the two slide plates 74 are restricted from moving relative to the cam surface 82 of the cam plate 80, and the driven pieces 84 are rotationally driven by the cam plate 80 without sliding relative to the cam surface 82 of the cam plate 80. Thus, the rotation movement of the annular external gear 78 is transmitted to the two slide plates 74. Hence, the two slide plates 74 and the rotation plate 88 supporting the slide plates 74 rotate integrally with the annular external gear 78. Thus, it is possible to rotate the tie rod hexagonal portion 12 by driving the two slide plates 74 about the center axis C12 of the tie rod hexagonal portion.

As described above, the open-end wrench 70 in accordance with the third embodiment of the invention is able to securely clamp the tie rod hexagonal portion 12 and rotate the tie rod hexagonal portion 12 regardless of the size of the diameter of the tie rod 10, by appropriately changing the distance between the surfaces of the two mutually facing contact portions 76 through the open-close drive mechanism 72 of the clamping mechanism 16 is driven by the rotation drive mechanism 18. Substantially the same operation and effects as those of the first and second embodiments of the invention will not be described in detail again.

Figure 5:
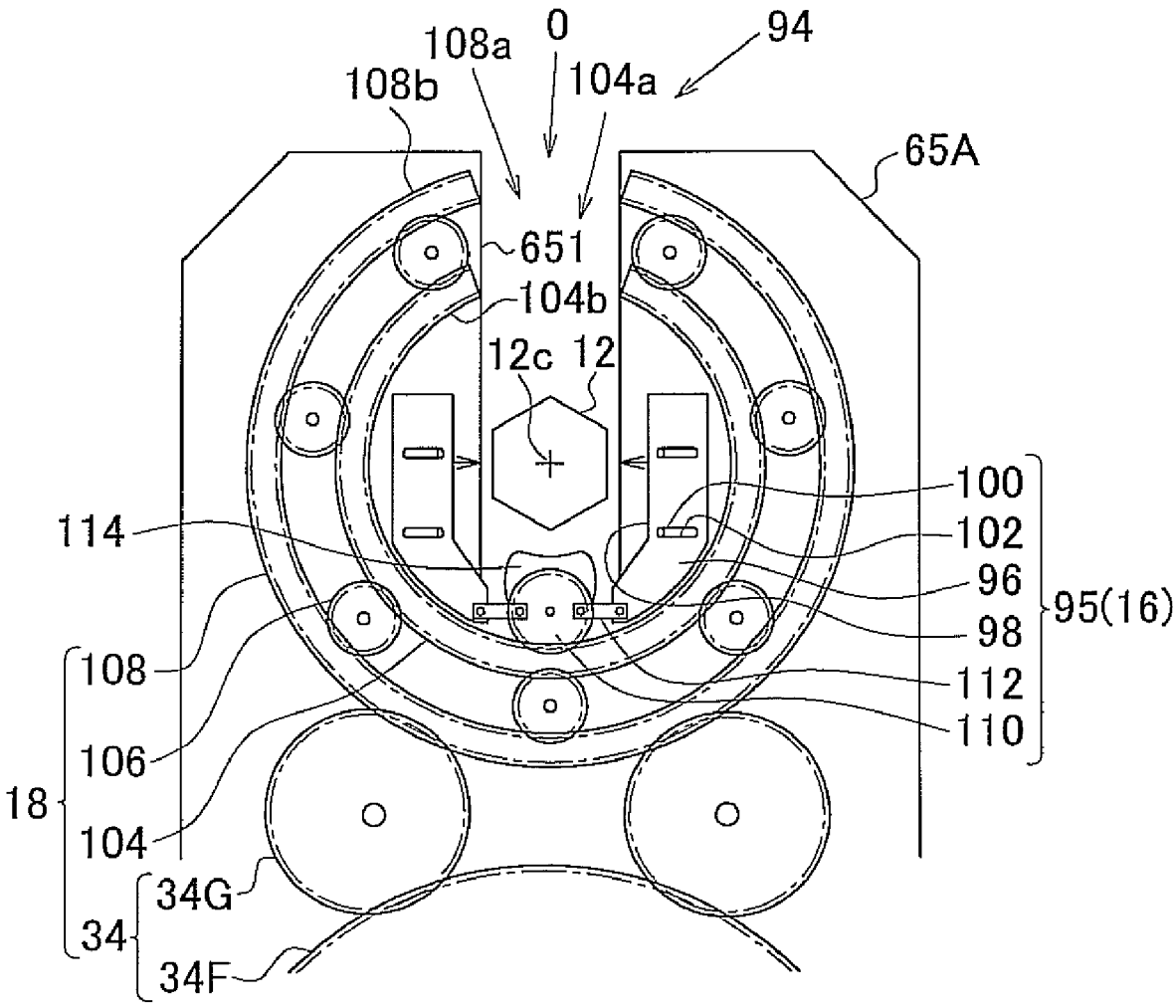
FIG. 5 is a front view showing an internal structure of a tie rod adjustment open-end wrench in accordance with a fourth embodiment of the invention.

Subsequently, with reference to FIG. 5, a tie rod adjustment open-end wrench 94 (hereinafter, simply referred to as "open-end wrench") in accordance with a fourth embodiment of the invention will be described. It is to be noted herein that portions of the open-end wrench 94 in accordance with the fourth embodiment that are the same as or comparable to those of the open-end wrenches 14, 52 and 70 in accordance with the first to third embodiments of the invention are represented by the same reference numerals, and detailed descriptions thereof will be omitted.

The open-end wrench 94 in accordance with the fourth embodiment of the invention, similar to the open-end wrench 70 in accordance with the third embodiment, includes a mechanism in which an open-close drive mechanism 95 of the clamping mechanism 16 is driven by a rotation drive mechanism 18. Concretely, the open-close drive mechanism 95 of the clamping mechanism 16 includes a pair of slide plates 96 that move away from and approach each other in slide movement, and mutually parallel end surfaces 98 of the two slide plates 96 are formed in a configuration of mutually parallel flat surfaces, as the two contact portions facing each other which is capable of directly contacting the tie rod hexagonal portion 12 (FIG. 6). The two slide plates 96 are slidable in such directions as to move away from and approach each other since guide grooves 102 are fitted over guide pins 100. In addition, the guide pins 100 are rotatable, together with a slide plate drive gear 110 (described below), about the center axis 12C of the tie rod hexagonal portion.

Besides, the rotation drive mechanism 18 rotationally drives the two slide plates 96 about the center axis 12C of a tie rod hexagonal portion 12. More concretely, the rotation drive mechanism 18 includes a planetary gear mechanism that includes an annular sun gear 104 provided at such a position as to surround the clamping mechanism 16, planetary gears 106 positioned radially outwardly of the sun gear 104, and an annular outer ring gear 108 positioned radially outwardly of the planetary gears 106. The sun gear 104 and the outer ring gear 108 each have a C-shape with a partial cutout, and the cutout portions 104*a* and 108*a* of the gears are disposed at an open-end portion O into which the tie rod hexagonal portion 12 is inserted when the clamping mechanism 16 approaches the tie rod 10 from a side of the tie rod. A certain amount of braking is applied to a carrier that supports the planetary gears 106 by shafts or the like. Ordinarily, the planetary gears 106 do not revolve around the axis of the sun gear 104, but rotate about their own axes at fixed locations. If a certain load or greater is applied in the revolving direction, the planetary gears 106 start revolving. Furthermore, teeth are formed on an inner peripheral surface 104*b* of the sun gear 104, and on an outer peripheral surface 108*b* of the outer ring gear 108, and a gear train 34 that drives the teeth of the outer peripheral surface 108*b* of the outer ring gear 108 is provided. The gear train 34, as in the open-end wrenches 52 and 70 of the second and third embodiments of the invention, includes a gear 34F fixed to a drive shaft linked to a rotation shaft of the motor, and a pair of gears 34G disposed between the gear 34F and the outer ring gear 108.

Besides, the open-close drive mechanism 95 of the clamping mechanism 16 includes a slide plate drive gear 110 that is journaled, or supported by a shaft or the like, at a proximal end side of the two slide plates 96, rotatably together with the two slide plates 96 about the center axis 12C of the tie rod hexagonal portion, and that meshes with the teeth formed on the inner peripheral surface 104*b* of the sun gear 104, and a link mechanism 112 that converts the rotation movement of the slide plate drive gear 110 into slide movements of the two slide plates 96. The link mechanism 112 shown in FIG. 5 is a mechanism in which a side surface of the slide plate drive gear 110, and the two slide plates 96 are attached to each other by shafts or the like. When the slide plate drive gear 110 rotates in either left or right direction from the rotation center position shown, the two slide plates 96 slide in such directions as to approach each other. Besides, as the slide plate drive gear 110 rotates in such a direction as to return to the rotation center position, the two slide plates slide in such directions as to move away from each other. When the slide plate drive gear 110 is at the rotation center position as shown in FIG. 5, the two slide plates 96 are farthest apart from each other. Besides, a stopper 114 that the tie rod hexagonal portion 12 contacts is shown in FIG. 5. Incidentally, the toe adjustment procedure for a motor vehicle using the open-end wrench 94 is substantially the same as the procedure using the open-end wrench 14 in accordance with the first embodiment, and the detailed description of the procedure is omitted herein.

According to the fourth embodiment of the invention having the foregoing construction, it becomes possible to achieve operation and effects as follows. In the open-end wrench 94, each of the annular external gear 104 and the annular outer ring gear 108 that are disposed at such positions as to surround the clamping mechanism 16 has a C-shape with a partial cutout, and the cutout portions 104*a* and 108*a* of the gears are disposed at the open-end portion O into which the tie rod hexagonal portion 12 is inserted when the clamping mechanism 16 approaches the tie rod 10 from a side of the tie rod. Hence, it is possible to accommodate the hexagonal portion 12 of a permissible maximum diameter in the open-end portion O when the two slide plates 96 are farthest apart from each other.

When the annular outer ring gear 108 is rotationally driven by the gear train 34 of the rotation drive mechanism 18 during a state in which the revolution of the planetary gears 106 about the axis of the sun gear 104 has been stopped, and the rotation thereof about their own axes is possible, rotation of the annular outer ring gear 108 is transmitted to the annular sun gear 104, and therefore the slide plate drive gear 110 meshed with the teeth formed on the inner peripheral surface 104*b* of the sun gear rotates. Then, rotation movement of the slide plate drive gear 110 is converted into slide movements of the two slide plates 96 by the link mechanism 112. That is, the open-end wrench 94 in accordance with the fourth embodiment of the invention is able to securely clamp the tie rod hexagonal portion 12 regardless of the size of the diameter of the tie rod 10, by using the open-close drive mechanism to bring the mutually facing end surfaces 98 of the slide plates 96, which are formed in a configuration of mutually parallel flat surfaces, into contact with the tie rod hexagonal portion 12 by the operation of the rotation drive mechanism 18.

Besides, as the mutually facing end surfaces 98 of the slide plates 96 contact the tie rod hexagonal portion 12 and the two slide plates 96 stops, the rotation of the slide plate drive gear 110 is restricted, bringing about a state in which the slide plate drive gear 110, the annular sun gear 104, and the planetary gears 106 are all locked, and rotate integrally with the annular outer ring gear 108. At this time, the two slide plates 96 and the slide plate drive gear 110 also rotate, together with the annular outer ring gear 108, about the center axis 12C of the tie rod hexagonal portion, thereby rotationally driving the tie rod hexagonal portion. Substantially the same operation and effects as those of the first to third embodiments of the invention will not be described in detail again.

The foregoing embodiments illustrate the construction of the invention, and do not limit the technical scope of the invention. Constructions obtained by replacing or deleting one or more component elements in the constructions of the foregoing embodiments, or by adding one or more other component elements to the foregoing constructions while the best modes for carrying out the invention are taken into consideration, can also be within the technical scope of the invention.

What is claimed is:

1. A tie rod adjustment open-end wrench comprising:

a clamping mechanism that clamps a tie rod hexagonal portion by approaching a tie rod from a side of the tie rod; and a rotation drive mechanism that rotates the clamping mechanism while the tie rod hexagonal portion is clamped, wherein the clamping mechanism includes:

a pair of contact portions facing each other which is capable of directly contacting the tie rod hexagonal portion; and an open-close drive mechanism that causes the both contact portions to move away from and approach the tie rod hexagonal portion, the open-close drive mechanism operates independently of the rotation drive mechanism, wherein the open-close mechanism of the clamping mechanism includes:

a pair of slide plates that move away from and approach each other in slide movement, a linear actuator, a cam mechanism that converts movement of the linear actuator into open-close movement of the pair of slide plate, and a spring that urges the pair of slide plates always in opening directions;

the pair of slide plates and the spring are held rotatably about a center axis of the tie rod hexagonal portion by an annular external gear that is disposed at such a position as to surround the pair of slide plates and the spring;

the annular external gear has a C-shape with a cutout portion;

the cutout portion is disposed at an open-end portion into which the tie rod is inserted when the clamping mechanism approaches the tie rod from the side of the tie rod;

mutually facing end surfaces of the slide plates, as the contact portions, are formed in a configuration of mutually parallel flat surfaces; and the rotation drive mechanism includes the annular external gear, and a gear train for rotating the annular external gear.

2. An open-end wrench comprising:

a clamping mechanism that clamps a hexagonal portion; and a rotation drive mechanism that rotates the clamping mechanism while the hexagonal portion is clamped, wherein the clamping mechanism includes:

a pair of contact portions facing each other which is capable of directly contacting the hexagonal portion; and an open-close drive mechanism that causes the both contact portions to move away from and approach the hexagonal portion, the open-close drive mechanism operates independently of the rotation drive mechanism, wherein the open-close mechanism of the clamping mechanism includes:

a pair of slide plates that move away from and approach each other in slide movement, a linear actuator, a cam mechanism that converts movement of the linear actuator into open-close movement of the pair of slide plate, and a spring that urges the pair of slide plates always in opening directions;

the pair of slide plates and the spring are held rotatably about a center axis of the hexagonal portion by an annular external gear that is disposed at such a position as to surround the pair of slide plates and the spring;

the annular external gear has a C-shape with a cutout portion;

the cutout portion is disposed at an open-end portion into which the hexagonal portion is inserted when the clamping mechanism approaches the hexagonal portion from a side of the hexagonal portion;

mutually facing end surfaces of the slide plates, as the contact portions, are formed in a configuration of mutually parallel flat surfaces; and the rotation drive mechanism includes the annular external gear, and a gear train for rotating the annular external gear.

* * * * *